United States Patent [19]

Samonov

[11] 4,136,426

[45] Jan. 30, 1979

[54] SPINDLE FOR A MACHINE FOR SEALING ELECTRIC VACUUM DEVICES

[76] Inventor: Valentin T. Samonov, ulitsa Svetotekhniki 53, kv. 49, Saransk Mordovskoi ASSR, U.S.S.R.

[21] Appl. No.: 797,313

[22] Filed: May 16, 1977

Related U.S. Application Data

[63] Continuation of Ser. No. 715,573, Aug. 18, 1976, abandoned, which is a continuation of Ser. No. 565,458, Apr. 7, 1975, abandoned.

[51] Int. Cl.[2] ..... H01J 9/46

[52] U.S. Cl. ..... 29/25.19; 29/427; 228/264

[58] Field of Search ..... 29/25.19, 25.2, 426, 29/427; 316/27, 31; 228/264

[56] References Cited

U.S. PATENT DOCUMENTS 2,162,209 6/1939 Trutner ..... 316/31

*Primary Examiner*—Richard B. Lazarus

*Attorney, Agent, or Firm*—Haseltine, Lake & Waters

[57] ABSTRACT

A spindle for a machine for sealing electric vacuum devices, comprising a housing, a hollow sleeve rotating in the housing, a central arbor accommodated within the hollow sleeve and movable relative thereto, the arbor carrying a candle-like plug adapted to receive therein a foot or stem of an electric vacuum device, e.g. lamp or tube. A crosspiece rotates together with the central arbor and has mounted thereon uprights supporting a holder adapted to retain therein the bulb or envelope of an electric vacuum device, the spindle also incorporating a mechanism for removing automatically a stem that has been welded to the candle-like plug.

6 Claims, 5 Drawing Figures

SPINDLE FOR A MACHINE FOR SEALING ELECTRIC VACUUM DEVICES

This is a continuation of application Ser. No. 715,573 filed Aug. 18, 1976 now abandoned, which is a continuation of Ser. No. 565,458 filed Apr. 7, 1975, now abandoned.

The present invention relates to the art of electrical industry and, more particularly, it relates to equipment for production of electric vacuum devices, e.g. of commonly used incandescent lamps. Still more particularly, it relates to spindles for a machine for sealing electric vacuum devices and is designed for sealing illuminating lamps in sealing machines with either intermittent or continuous motion of work-carrying stations.

Widely known are spindles for machines for sealing light sources, consisting of a housing, a hollow sleeve rotatably mounted in the housing, a central arbor with a candle-like plug accommodated within the hollow sleeve and movable in relation thereto, the candle-like plug being adapted to receive therein the foot or stem of the electric vacuum device, and a crosspiece rotatable jointly with the central arbor, the crosspiece carrying uprights on which there is mounted a holder retaining the envelope or bulb of the vacuum device.

These mentioned spindles are employed for sealing illuminating lamps and other electric vacuum devices in sealing machines of the turnable and conveyor types, wherein the work-supporting stations move intermittently.

The main disadvantage of the known spindles is the fact that the stem of the lamp may get welded to the candle-like plug of the central arbor if for some reason the bulb has not been loaded into the holder. In an automatic high-speed machine which is not permanently supervised by an operator such defective sealing station, i.e. the spindle with the stem welded thereto, may constitute for prolonged period a source of waste, since it is impossible to load a new stem into this station. Removal of the piece of glass welded to the candle-like plug is particularly difficult in case of machines with continuous motion of the sealing stations.

It is an object of the present invention to provide a simple and dependable structure of a spindle for a machine for sealing electric vacuum devices, providing for downtime-free operation and increased productivity of a machine for sealing such vacuum devices, the spindle being incorporable in automatic machines with continuous motion of the work-supporting stations.

This object is accomplished in a spindle of the above-described type for a machine for sealing electric vacuum deces, incorporating, in accordance with a present invention, a mechanism for automatic removal of a stem welded to the candle-like plug.

In accordance with the invention, it is expedient that the mechanism for automatic removal of a stem welded to the candle-like support should include spring-biased arms, the upper portion of each arm having a pointed end, the ends embracing the central arbre therebetween.

The proposed spindle for a machine for sealing electric vacuum devices, incorporating a mechanism for automatic removal of a stem welded to the candle-like plug, eliminates the abovementioned disadvantage and provides for downtime-free operation of the machines of the specified kind and for their substantially increased productivity.

Given hereinbelow is a description of an embodiment of the herein disclosed spindle for a machine for sealing electric vacuum devices, with reference being had to the accompanying drawings, wherein.

Figure 1:
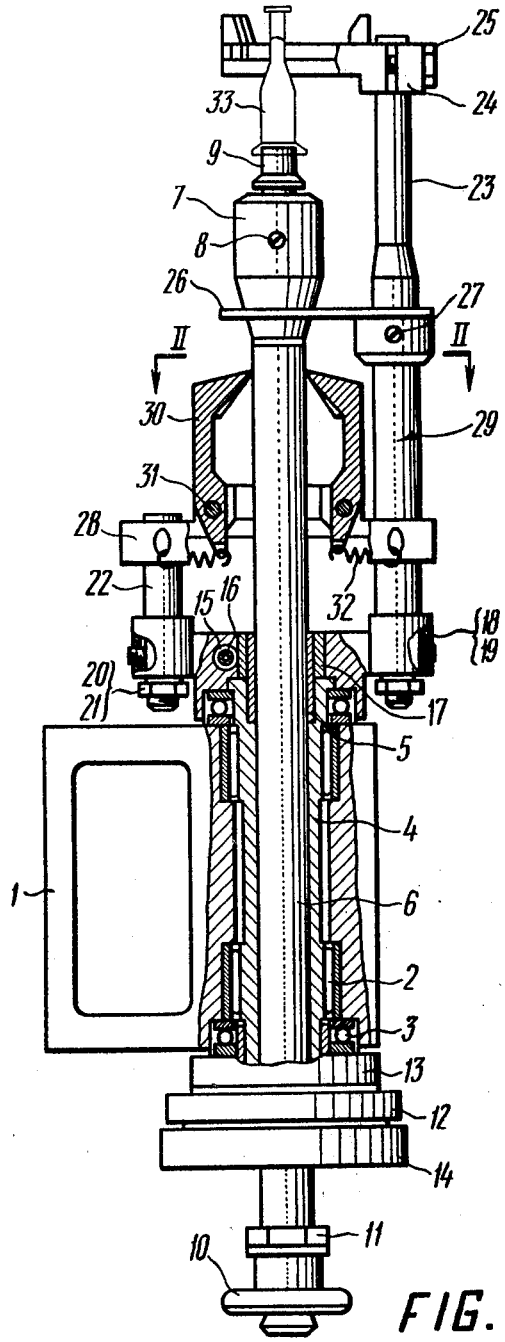
FIG. 1 is a partly longitudinally sectional view of a spindle for a machine for sealing electric vacuum devices.

In the drawings, wherein FIG. 1 illustrates sealing of an electric incandescent lamp, the spindle is mounted in a housing 1 wherein radial bearings 2 and thrust bearings 3 rotatably support a hollow sleeve 4 having bushings 5 accommodating therein a central arbor 6 carrying on the upper end thereof a candle-like plug 7 retained with a screw 8 and an end piece 9, the bottom end of the arbor 6 carrying a shoe 10 locked with a nut 11. The central arbor 6 is rotatable jointly with the sleeve 4 and is axially movable relative thereto. Rotation is transmitted to the sleeve 4 and to the central arbor 6 keyed thereto (the key is not shown) from a driven pinion 12 through a spring-urged friction disc 13. The pinion 12 is rotatable by a toothed rack (not shown). For accurate angular indexing of the central arbor 6 when its rotation is arrested there is provided a pinion 14 fast with the friction disc 13. There is mounted on the upper portion of the sleeve 4, by means of a screw clamp 15 including a bolt 16 and a split bushing 17, a crosspiece 18 wherein screws 19 and nuts 20 with washers 21 secure two uprights — the shorter one 22 and the longer one 23. The longer upright has mounted thereon a holder or cup 24 adapted to retain a bulb or envelope of a lamp (not shown), secured with a screw 25, a stop 26 provided to limit sagging of the bottom part of the bulb (not shown) when the latter is heated up during a sealing operation, secured with a screw 27, as well as the support panel 28 of the mechanism 29 for removing a stem welded to ghe candle-like plug 7, the panel being also supported by the shorter upright 22.

Figure 2:
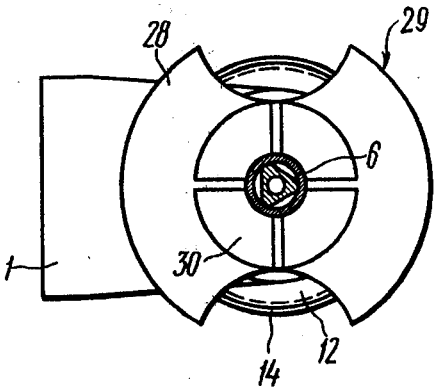
FIG. 2 is a sectional view taken on line II — II of FIG. 1.

The support panel 28 has mounted thereon four arms 30 of the mechanism 29, having pointed upper ends, trimmed along arc of a circle and embracing therebetween the central arbor 6, which can be seen in FIG. 2. The arms 30 are pivotable about respective pins 31 (FIG. 1) and are biased against the central arbor by springs 32. The stem 33 of a lamp (not shown) can be introduced into the end piece 9.

The herein disclosed spindle operates, as follows.

Figure 5:
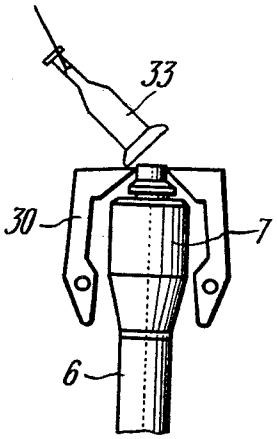
FIGS. 3, 4 and 5 illustrate the sequence of operations performed by the mechanism for automatic removal of a stem welded to the candle-like plug.
Figure 4:
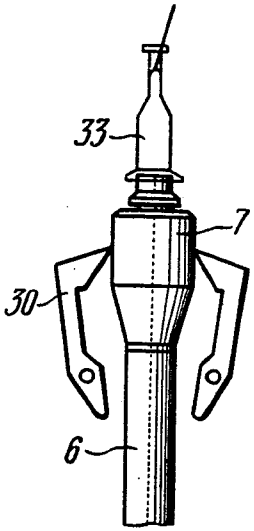
Figure 3:
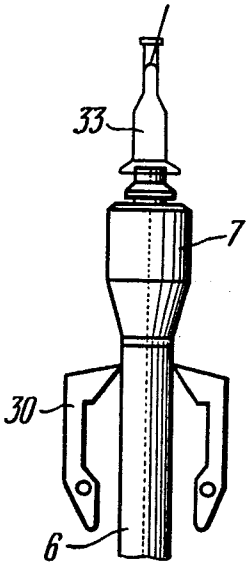

When the arbor 6 (FIGS. 1 and 3) is forced down by a cam (not shown) mounted in the path of the spindle, the spring-biased arms 30 slide upwardly along the surface of the candle-like plug 7 (FIG. 4) from their initial position. As the arbor 6 (FIG. 5) with the candle-like plug 7 is driven into its downmost position, the pointed ends of the arms 30 remove automatically a welded-on stem 33.

We claim:

1. A spindle for a machine for processing electric vacuum devices, comprising: a housing; a hollow sleeve rotatable mounted in said housing; a central arbor within said hollow sleeve and movable relative thereto; a candle-like plug carried by said central arbor, said candle-like plug having a weld holding a stem of an electric vacuum device; said arbor being axially movable within said sleeve; and stem removal means in contact with said arbor and being actuated when said arbor is moved axially relative to said stem removal means, said stem removal means removing said stem from said candle-like plug when said arbor is displaced axially by a predetermined distance.

2. A spindle as defined in claim 1 wherein said stem removal means comprises a plurality of arms having end portions in contact with said central arbor and engaging said stem welded to said candle-like plug when said arbor is displaced axially by said predetermined distance, said end portions of said arms becoming displaced towards the axis of said arbor when said arbor is displaced axially by said predetermined distance for removing said welded stem.

3. A spindle as defined in claim 2 including pivot means for pivoting said arms; spring means connected to said arms for urging said pivoted arms so that said end portions of said arms are retained in contact with said arbor when said arbor is axially displaced.

4. A spindle as defined in claim 3 wherein said pivoted arms comprise two armed levers, said end portions of said arms being at ends of one arm of said two armed levers, and said spring means being connected to the other arm of said levers; and a tapered portion on said arbor, said end portions of said arms contacting said tapered portion for actuating said arms when said arbor is axially displaced.

5. A spindle as defined in claim 1 wherein said arms comprise four arms having pointed upper ends curved along an arc of a circle, said four pointed ends embracing said central arbor therebetween.

6. The spindle as defined in claim 4 including a cross-piece connected to said central arbor and supporting said arms.

* * * * *